United States Patent [19]

Sakaki

[11] Patent Number: 4,473,279

[45] Date of Patent: Sep. 25, 1984

[54] DEVICE FOR CLEANING TRANSPARENT PLATES OF DETECTING SECTIONS OF COLOR SORTING APPARATUS

[75] Inventor: Hideki Sakaki, Hiroshima, Japan

[73] Assignee: Satake Engineering Co., Ltd., Tokyo, Japan

[21] Appl. No.: 360,060

[22] Filed: Mar. 22, 1982

[30] Foreign Application Priority Data

Mar. 26, 1981 [JP] Japan ..... 56/43134

[51] Int. Cl.[3] ..... A47L 1/02

[52] U.S. Cl. ..... 350/582; 15/250.19

[58] Field of Search ..... 350/582, 584; 15/250.26, 250.29, 256.53, 250.24

[56] References Cited

U.S. PATENT DOCUMENTS

| | | | |
|---|---|---|---|
| 2,648,087 | 8/1953 | Kiker, Jr. | 15/250.29 |
| 3,837,032 | 9/1974 | Ulbrich | 15/250.29 |
| 4,057,146 | 11/1977 | Castaneda et al. | 350/584 |

FOREIGN PATENT DOCUMENTS

| | | | |
|---|---|---|---|
| 149667 | 11/1980 | Japan | 350/582 |
| 141641 | 11/1980 | Japan | 350/584 |
| 1095590 | 12/1967 | United Kingdom | 15/250.29 |

*Primary Examiner*—William H. Punter

*Attorney, Agent, or Firm*—Norbert P. Holler; Charles A. Blank

[57] ABSTRACT

A device for cleaning transparent plates mounted in the detecting sections of a color sorting apparatus adapted to sort granular materials such as rice according to their colors. The device has a guide rail extended in parallel with each transparent plate, a cleaning plate assembly having a wiper making a close contact with the surface of the transparent plate and movably mounted on the guide rail, and means for reciprocatingly driving the cleaning plate assembly along the guide rail. The driving means may incorporate a reversible motor fixed to the cleaning plate assembly and a roller drivingly connected to the shaft of the motor and adapted to roll on the guide rail. As the driving means operates, the wiper of the cleaning plate assembly wipes off the contaminants on the surface of the transparent plate to clean the latter, thereby to ensure stable sorting operation of the apparatus. The cleaning device may be operated optionally through manipulation of a switch or fully automatically by means of a controller incorporating a timer at a suitable period.

7 Claims, 3 Drawing Figures

DEVICE FOR CLEANING TRANSPARENT PLATES OF DETECTING SECTIONS OF COLOR SORTING APPARATUS

The present invention relates broadly to a color sorting apparatus for separating granular material from aimed granular material according to their colors and, more particularly, to a device for cleaning the transparent plate mounted in the detecting section of a color sorting apparatus of the kind mentioned above.

Such a color sorting apparatus has been known as adapted to separate granular material of different colors from aimed granular material of a predetermined color such as polished rice according to their colors. This apparatus has a sorting box carrying a chute through which the granular materials are continuously applied into the sorting box to flow downward therein along a predetermined path. A photoelectric detecting section disposed at each side of the path of flow of the granular materials has a detector adapted to detect the color or transparency of the granular materials. The detector produces a signal when it detects a color or transparency different from that of the aimed granular material, and an air nozzle is activated in accordance with the signal to jet compressed air thereby to blow the granular material of the different color or transparency away from the path to separate such granular material from the aimed granular material.

In this type of sorting apparatus, it is often experienced that the transparent plates mounted in the detecting section is contaminated by rice brans, dusts and other contaminants attaching thereto, to adversely affect the detecting operation. In order to maintain the expected detecting performance, therefore, it is necessary to remove these contaminants from the transparent plate.

To this end, in the conventional color sorting apparatus, the sorting box is provided at a portion thereof with an access window through which the operator inserts his hand or a suitable cleaning tool to wipe off the contaminants. The necessity for such an access window inevitably increases the size of the sorting box to require greater amount of material resulting in a raised cost of production. In addition, it is necessary to suspend the operation of the sorting apparatus during cleaning of the transparent plates.

Under this circumstance, the present invention aims as its major object at providing a device for cleaning the transparent plates of detecting section of a color sorting apparatus, capable of cleaning the transparent plates easily, safely and automatically, thereby to eliminate the above-described problem of the prior art.

To this end, according to the invention, there is provided a device for cleaning transparent plates of detecting section of a color sorting apparatus comprising: a guide rail extended in parallel with each transparent plate; a cleaning plate assembly movable along each guide rail and having a wiper making a close contact with the surface of the transparent plate; and driving means adapted to drive each cleaning plate assembly reciprocatingly along the guide rail.

The above and other objects, features and advantages of the invention will become clear from the following description of the preferred embodiment taken in conjunction with the accompanying drawings in which.

Figure 1:
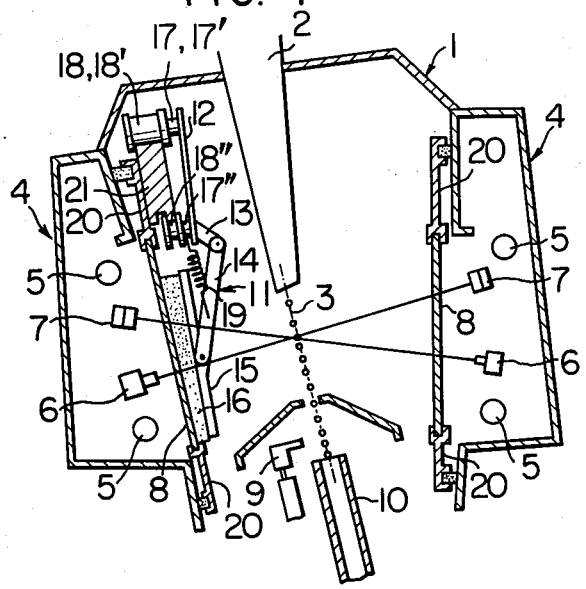
FIG. 1 is a sectional view of a sorting box of a color sorting apparatus to which the present invention is applied.

Referring first to FIG. 1, a sorting box 1 of a color sorting apparatus has a chute 2 mounted thereon. Granular materials to be sorted are supplied from the chute 2 into the sorting box 1 to continuously flow down along a linear path 3 in the sorting box. A detecting section 4 is defined at each side of the sorting box 1. Namely, a pair of detecting sections 4 are disposed to oppose to each other in symmetry with respect to the path 3 of flow of the grain materials. Each detecting section 4 has fluorescent tubes 5 serving as illumination light sources, a sensor 6 and a background 7 which are separated from the space inside the sorting box by a transparent plate which is in this case a glass plate 8. Each light source 5 illuminates the flux of granular materials flowing down along the path 3, and the difference between the amount of light reflected or transmitted by the flux of grain materials and the amount of light coming from the background 7 is detected by the sensor 6.

A reference numeral 9 denotes an air nozzle disposed in the vicinity of the path 3 of the granular material. As the sensor 6 detects the presence of granular material of a color or transparency different from that of the granular material aimed along the path 3 by the chute 2, the sensor produces a signal which acts to activate the air nozzle 9 so that compressed air is jetted from the air nozzle 9 towards the path 3 of the granular materials to blow the granular materials of the different color or transparency away from the path 3. On the other hand, the aimed granular material having predetermined color or transparency is allowed to continuously flow down along the path 3 and is discharged to the outside of the apparatus through a granular material collecting sleeve 10.

During this sorting operation, contaminants such as rice brans, dusts and so forth contained by the aimed granular material which is, in this case, polished rice attach to each glass plate 8 to contaminate the latter to seriously deteriorate the detecting performance.

Such contaminants can be removed from the glass plate 8 easily, automatically and safely by the transparent plate cleaning device of the invention.

The transparent plate cleaning device of this embodiment has a cleaning plate assembly 11 which includes a cleaning plate 12, lugs 13 projecting from the side of the cleaning plate, a connecting rod 14 swingably supported at its one end by the lugs 13, a clamping member 15 pivotally secured to the other end of the connecting rod 14 and a rubber wiper 16 clamped by the clamping member 15.

The cleaning plate assembly 11 further has supporting members 17, 17' projecting from the other side of the cleaning plate 12 at a suitable distance from each other in the horizontal direction, a supporting member 17'' projecting from the other side of the cleaning plate 12 at a lower portion thereof, rollers 18, 18', 18'' rotatably supported by the supporting members 17, 17', 17'' and a biasing member consisting of a spring 19 connected between the supporting member 17'' of the lower roller 18'' and the connecting rod 14. The biasing member serves to continuously bias the wiper 16 into close contact with the surface of the glass plate 8.

A guide rail 21 is fixed to a guide rail mounting plate 20 which is secured to the wall of the sorting box 1 so as to extend along the upper edge of the glass plate 8. The aforementioned cleaning plate assembly 11 is mounted on the guide rail 21 such that the roliers 18, 18' and the roller 18 make rolling contact with the upper edge and lower edge of the guide rail 21, respectively. Thus, the cleaning plate assembly 11 is movable along the guide rail 21. The guide rail and the cleaning plate assembly for the glass plate 8 attached to the right-side detecting section 4 are omitted from FIG. 1 for the purpose of simplification of illustration.

Figure 2:
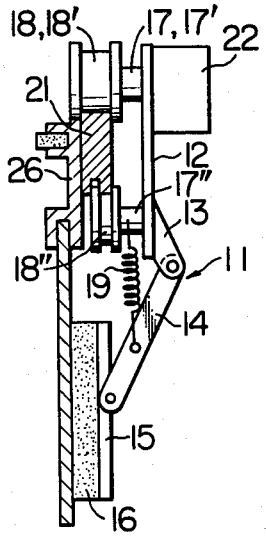
FIG. 2 is a sectional view of an essential part of an embodiment of the invention.

FIG. 2 shows an example of the driving device for reciprocatingly driving the cleaning plate assembly 11 along the guide rail 21. The arrangement is such that a shaft of one 18 of the upper rollers rotatably supported by the support member 17 is drivingly connected to the shaft of a reversible motor 22 mounted on the opposite side of the cleaning plate 12 to the rollers. Thus, the cleaning plate assembly 11 is reciprocatingly moved along the guide rail as the reversible motor 22 operates back and forth.

Figure 3:
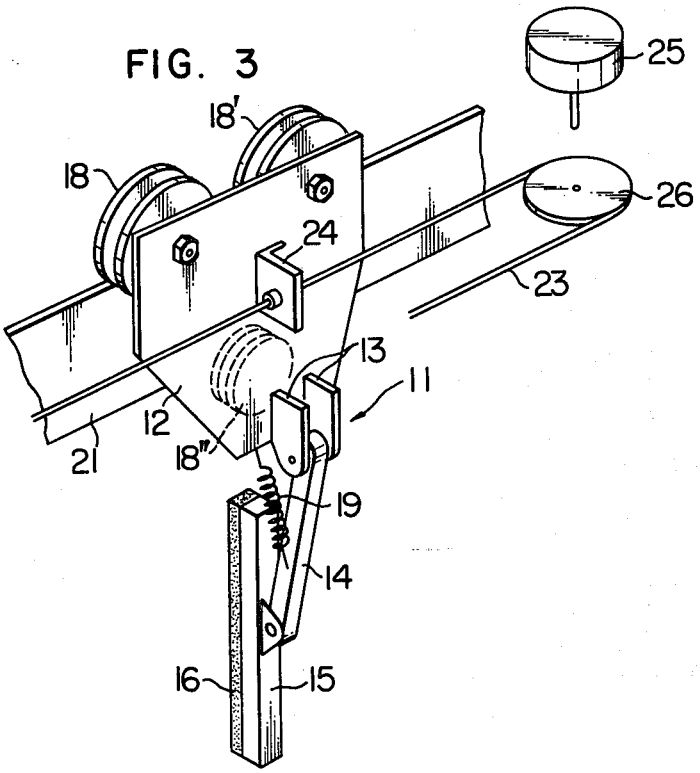
FIG. 3 is a perspective view of another embodiment.

FIG. 3 shows another example of the driving device for reciprocatingly driving the cleaning plate assembly. In this device, a stranded wire 23 is fixed to a bracket 24 provided on the cleaning plate 12. A reversible motor 25 is secured to the sorting box 1 at a portion of the latter near one end of the guide rail 21. The stranded wire 23 is wound round a pulley 26 operatively connected to the reversible motor 25 and an idle pulley (not shown) rotatably secured to the sorting box 1 at a portion near the other end of the guide rail. Thus, the cleaning plate assembly 11 is reciprocatingly driven by the reversible motor 25 through the pulley 26 and the stranded wire 23.

In the embodiments shown in FIGS. 2 and 3, the reversible motor 22 or 25 may be connected to a switch provided on the color sorting apparatus such that the reversible motor is activated to reciprocatingly drive the cleaning plate assembly selectively as desired through the manipulation of the switch. It is, however, preferred that the cleaning plate assembly is automatically driven intermittently at a suitable period by means of a controller incorporating a timer mounted on the color sorting apparatus and connected to the reversible motor.

The embodiments shown in FIGS. 2 and 3 incorporate a reversible motor for driving the cleaning plate. The mechanisms explained in connection with FIGS. 2 and 3, however, are not exclusive and the transparent plate cleaning device of the invention can employ various other mechanisms for reciprocatingly driving the cleaning plate assembly along the guide rail.

The cleaning plates assemblies for both detecting sections 4 opposing to each other may be driven independently of each other or, alternatively, the driving devices for these assemblies may be connected to each other mechanically or electrically so that both cleaning plate assemblies are driven simultaneously.

Although the embodiments described hereinbefore incorporate three rollers, two at the upper part of the cleaning plate and one at the lower part of the cleaning plate so that the cleaning plate is supported by the rail at three points. This arrangement, however, is not exclusive. All what is necessary is that the cleaning plate assembly is securely supported by the guide rail. Thus, the number and positions of the rollers in the described embodiments are not essential.

As has been described, according to the invention, there is provided a device for cleaning transparent plate having a cleaning plate assembly movable reciprocatingly along a guide rail disposed along each transparent plate.

In consequence, the manual work for cleaning the transparent plates, which has been necessary in the conventional color sorting apparatus, is completely eliminated. In addition, it becomes unnecessary to suspend the operation of the color sorting apparatus during cleaning of the transparent plates. Furthermore, by arranging such that the cleaning plate assemblies are driven automatically and intermittently, it becomes possible to effect the cleaning of the transparent plates fully automatically.

Thus, according to the invention, it is possible to efficiently remove the rice brans, dusts and other foreign matters attaching to the transparent plates in the detecting sections of the color sorting apparatus, thereby to ensure a stable and accurate sorting operation of the color sorting apparatus.

What is claimed is:

1. A color sorting apparatus comprising:

a chute having an upstream end and a downstream end for allowing a mixture of granular material having a desired color and granular material having different colors to flow down along said chute and to be shot out of said downstream end so as to form a granular-material stream along a predetermined path;

a pair of detecting units with one disposed at each side of said predetermined path, each of said detecting units including a housing having therein an opening, a transparent plate mounted on each said housing to substantially close said opening therein so as to define a chamber with each said housing, each said transparent plate having a surface thereof faced to said predetermined path, light source means within each said chamber for applying light through each said transparent plate to the granular-material stream to allow the light to be reflected by and/or transmitted through the granular material in the stream, and means within each said chamber for sensing the light reflected by and/or transmitted through the granular material and passing through each said transparent plate to generate a signal, the surface of the transparent plate of one of said pair of detecting units being faced to the surface of the transparent plate of the other detecting unit;

means operative in response to the signal for deflecting the granular material having different colors out of said predetermined path; and a transparent-plate cleaning device associated with each of said detecting untis for automatically cleaning the associated transparent plate, each said cleaning device comprising an elongated guide extending adjacent to a side edge of said associated transparent plate, each said guide including a guide rail located above the downstream end of said chute and extending generally in parallel to an upper side edge of said associated transparent plate, a carriage supported by said guide for reciprocating movement therealong, said carriage being disposed above the downstream end of said chute, a wiper member, said wiper member being elongated so as to have its axis extending generally perpendicularly to said guide rail, connection means for connecting said wiper member to said carriage so as to be pivotable toward and away from the surface of said associated transparent plate around an axis entending generally in parallel to the reciprocating movement of said carriage, spring means for resiliently biasing said wiper member so as to cause the same to be in positively intimate contact with the surface of said associated transparent plate, and means for driving said carriage so as to be reciprocatingly moved along said guide to cause said wiper member to sweep contaminants deposited on the surface of said associated transparent plate to continuously maintain the surface of said associated transparent plate clean during the operation of said color sorting apparatus.

2. A color sorting apparatus defined in claim 1, wherein the granular material having a desired color is rice, and the contaminants deposited on the surface of said associated transparent plate primarily includes bran.

3. A color sorting apparatus defined in claim 2, wherein said carriage includes a body and a plurality of rollers rotatably mounted on said body and in rolling contact with said guide rail.

4. A color sorting apparatus defined in claim 3, wherein said rollers comprise at least one upper roller in rolling contact with an upper edge of said guide rail and at least one lower roller in rolling contact with a lower edge of said guide rail.

5. A color sorting apparatus defined in claim 4, wherein said driving means comprises a reversible motor mounted on said body of said carriage and drivingly connected to one of said rollers for rotating the same in the opposite directions.

6. A color sorting apparatus defined in claim 4, wherein said driving means comprises a cable loop having a portion thereof fixedly secured to said body of said carriage, at least two pulleys around which said cable loop is trained, and a reversible motor drivingly connected to one of said pulleys to rotate the same in the opposite directions.

7. A color sorting apparatus defined in claim 5 or 10, wherein said connection means comprises an arm having one end thereof pivotally connected to said body of said carriage and the other end pivotally connected to said wiper member, said spring means comprising a spring having one end thereof attached to said body of said carriage and the other end attached to said arm.

* * * * *

UNITED STATES PATENT AND TRADEMARK OFFICE

CERTIFICATE OF CORRECTION

PATENT NO. : 4,473,279

DATED : September 25, 1984

INVENTOR(S) : Sakaki, Hidek

It is certified that error appears in the above-identified patent and that said Letters Patent are hereby corrected as shown below:

Column 6, line 18, for "10" read --6--.

Signed and Sealed this

*Ninth* Day of *April 1985*

[SEAL]

*Attest:*

DONALD J. QUIGG

*Attesting Officer*

*Acting Commissioner of Patents and Trademarks*